US006827000B2

(12) United States Patent
Nagai et al.

(10) Patent No.: US 6,827,000 B2
(45) Date of Patent: Dec. 7, 2004

(54) FUEL INJECTION PUMP

(75) Inventors: Koichi Nagai, Toyoake (JP); Jun Kondo, Obu (JP)

(73) Assignee: Denso Corporation (JP)

( * ) Notice: Subject to any disclaimer, the term of this patent is extended or adjusted under 35 U.S.C. 154(b) by 61 days.

(21) Appl. No.: 10/310,850

(22) Filed: Dec. 6, 2002

(65) Prior Publication Data

US 2003/0106427 A1 Jun. 12, 2003

(30) Foreign Application Priority Data

Dec. 7, 2001 (JP) ..... 2001-374078

(51) Int. Cl.[7] ..... F01B 1/00
(52) U.S. Cl. ..... 92/72
(58) Field of Search ..... 91/491; 92/61, 92/72; 417/273

(56) References Cited

U.S. PATENT DOCUMENTS 2,324,291 A * 7/1943 Dodge ..... 417/273
4,975,025 A 12/1990 Yamamura et al.

FOREIGN PATENT DOCUMENTS

DE 4107952 A 9/1991
EP 0520286 A 12/1992

* cited by examiner

*Primary Examiner*—F. Daniel Lopez
(74) *Attorney, Agent, or Firm*—Nixon & Vanderhye PC

(57) ABSTRACT

In a fuel injection pump, axial ends of first and second plungers driven by a drive shaft via a cam and a cam ring are in slidable contact with first and second sliding surfaces of the cam ring. The first and second sliding surfaces are positioned on opposite sides of the drive shaft and non-parallel. When the first plunger is in compression stroke, a wedge shaped gap whose angle is α is formed between the axial end of the second plunger and the second sliding surface. Accordingly, when the second plunger is in the compression stroke, sliding contact portions of the axial end of the second plunger and the second sliding surface are well lubricated by fuel entered the gap, resulting in preventing frictional seizure thereof.

2 Claims, 5 Drawing Sheets

FUEL INJECTION PUMP

CROSS REFERENCE TO RELATED APPLICATION

This application is based upon and claims the benefit of priority of Japanese Patent Application No. 2001-374078 filed on Dec. 7, 2001, the content of which is incorporated herein by reference.

BACKGROUND OF THE INVENTION

1. Field of the Invention

The present invention relates to a fuel injection pump for an internal combustion engine (hereinafter called "engine") in which mutual sliding contact portions of a cam ring and a plunger are well lubricated.

2. Description of the Prior Art

A conventional fuel injection pump for a diesel engine has a cam for driving a plunger as a movable member. In this pump, fuel is sucked and pressurized in a pressure chamber by reciprocating movement of the plunger axially slidable in a cylinder. A rotating movement of a drive shaft to be driven by an engine is converted to the reciprocating movement of the plunger inside the cylinder via the cam connected with the drive shaft and a cam ring disposed between the cam and the plunger.

To improve engine output and fuel consumption and to reduce emission such as NOx and black smoke to be exhausted from the engine, higher fuel injection pressure has been recently demanded.

To secure the higher fuel injection pressure, it is necessary to increase pressure of fuel to be pressurized by and discharged from the fuel injection pump so that higher load is applied to the fuel injection pump. In particular, larger force acting on mutual sliding contact portions of the cam ring and the plunger is likely to cause frictional seizure between the sliding contact portions. Therefore, a part of fuel is bypassed and supplied to the sliding contact portions of the cam ring and the plunger for lubricating the sliding contact portions with an oil film to be formed by the fuel thus supplied.

However, when the plunger is in a compression stroke during which fuel in the pressure chamber is pressurized, the plunger receives a large reaction force acting toward the cam ring from the fuel to be pressurized in the pressure chamber so that the plunger comes in close contact with the cam ring. Further, when the plunger is in an intake stroke during which fuel is sucked into the pressure chamber, the plunger is also urged toward the cam ring by biasing force of a spring so that the plunger comes in close contact with the cam ring, similarly as in the compression stroke. Accordingly, fuel for lubrication does not sufficiently enter between the sliding contact portions of the plunger and the cam ring, which tends to cause the frictional seizure between the sliding contact portions since the oil film therebetween for lubrication is scarcely formed.

SUMMARY OF THE INVENTION

An object of the present invention is to provide a fuel injection pump in which oil film is easily formed between sliding contact portions of a plunger and a cam ring so that frictional seizure therebetween hardly occurs.

To achieve the above object, in a fuel injection pump having a drive shaft, an eccentric cam integrated with the drive shaft, a cam ring arranged around outer circumference of the cam shaft, a housing provided with a cylindrical bore and a movable member axially movable in the cylindrical bore, the cam ring is provided on outer circumference thereof with a sliding surface. The movable member is biased toward the drive shaft so that an axial end thereof is in contact with the sliding surface. Another axial end of the movable member and the cylindrical bore form a pressure chamber. The movable member not only moves axially toward the drive shaft to suck fuel into the pressure chamber and but also moves axially in a direction remote from the drive shaft to pressurize the fuel in the pressure chamber, while the axial end of the movable member slidably and reciprocatingly moves relatively to the sliding surface, according to movement of the ring cam driven by the drive shaft via the cam.

With the fuel injection pump mentioned above, only a part of the axial end of the movable member comes in contact with the sliding surface on one side of an axis of the drive shaft so that a gap is formed between the axial end of the movable member and the sliding surface on the other side of the axis of the drive shaft, in an intake stroke when the fuel is sucked into the pressure chamber, and a substantially entire part of the axial end of the movable member comes in contact with the sliding surface on both sides of the axis of the drive shaft, in a compression stroke when the fuel in the pressure chamber is pressurized. Since high load is not applied to the movable member in the intake stroke, the gap between the axial end of the movable member and the sliding surface of the cam ring does not cause any problem.

To the contrary, in the compression stroke when the high load is applied to the movable member via the cam and the cam ring from the drive shaft for pressurizing the fuel in the pressure chamber, the mutual sliding contact portions of the movable member and the cam ring can be well lubricated with the fuel entered the gap in the intake stroke.

It is preferable that height of the gap is relatively low but larger than that of each surface roughness of the axial end of the movable member and the sliding surface to an extent that an oil film by fuel is sufficiently formed between the axial end of the movable member and the sliding surface for preventing frictional seizure of mutual sliding contact portions of the movable member and the cam ring.

Further, it is preferable that another cylindrical bore, another sliding surface, another movable member and another pressure chamber, whose constructions are similar as the cylindrical bore, the sliding surface, the movable member and the pressure chamber and each of the another cylindrical bore, the another sliding surface, the another movable member and the another movable member is arranged on an opposite side of each of the cylindrical bore, the sliding surface, the movable member and the pressure chamber with respect to the drive shaft.

In this case, when the part of the axial end of the movable member comes in contact with the sliding surface for sucking the fuel into the pressure chamber in the intake stroke, the substantially entire part of the axial end of the another movable member comes in contact with the another sliding surface for pressurizing the fuel in the another pressure chamber in the compression stroke.

In more details, the sliding surface and the another sliding surface are formed in non-parallel. As an alternative, the sliding surface and the another sliding surface may be provided respectively with a projection and another projection onto which the movable member and the another movable member run when the fuel is sucked into the pressure chamber and the another pressure chamber, respectively. Each of these constructions is effective to form the gaps between the axial end of the movable member and the sliding surface of the cam ring and between the axial end of the another movable member and the another sliding surface of the cam ring in the intake stroke. Accordingly, the oil film formed by the fuel serves to prevent the frictional seizure of the sliding contact portions between the movable member and the cam ring and between the another movable member and the cam ring.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS

Preferred embodiments of the present invention are described with reference to drawings.

(First Embodiment)

Figure 1:
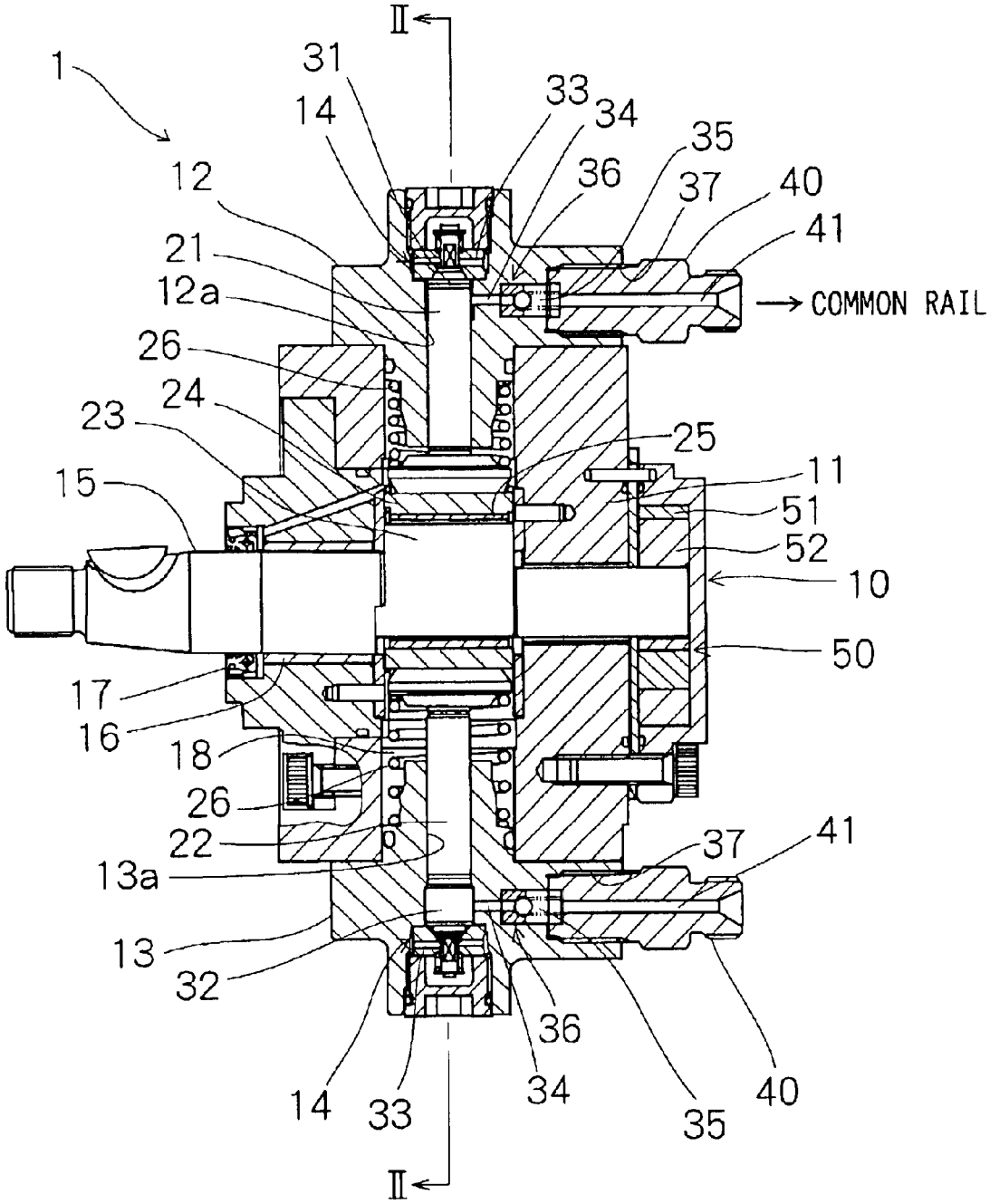
FIG. 1 is a schematic cross sectional view of a fuel injection pump according to a first embodiment of the present invention.

As shown in FIG. 1, a housing 10 of a fuel injection pump 1 has an aluminum housing body 11 and iron cylinder heads 12 and 13. The cylinder heads 12 and 13 are provided respectively with cylindrical bores 12*a* and 13*a* in which plungers 21 and 22 as movable members are accommodated to move axially and reciprocatingly, respectively. Each axial end of the plungers 21 and 22, each of the cylindrical bores 12*a* and 13*a* and each end of check valves 14 form each of pressure chambers 31 and 32. According to the present embodiment, the cylinder head 12 is formed substantially in the same shape as the cylinder head 13 except positions of a threaded hole and a fuel passage. The positions of the threaded hole and the fuel passage of the cylinder head 12 may be same as those of the cylinder head 13.

Figure 2:
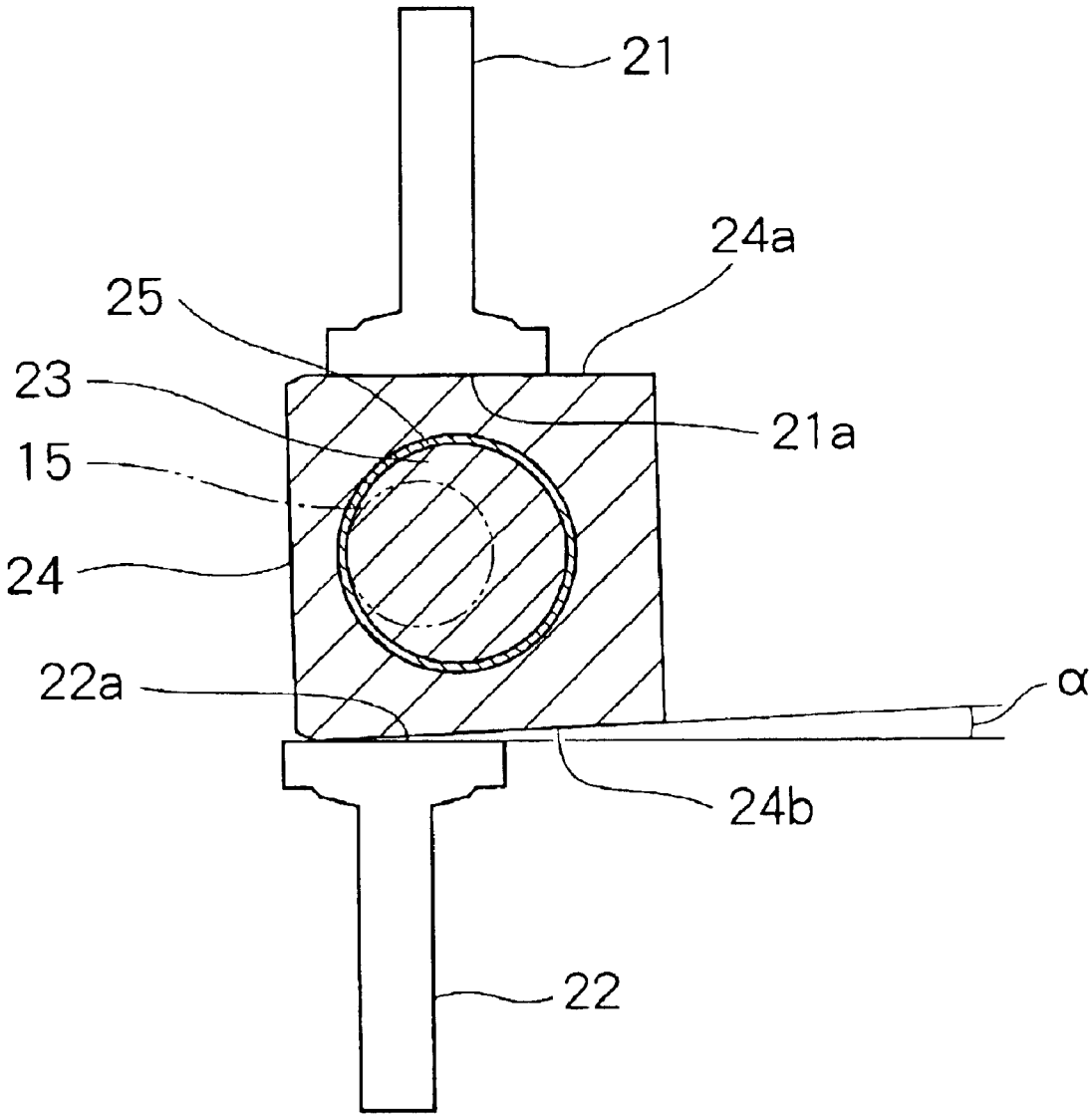
FIG. 2 is a cross sectional view showing a plunger and a cam ring of the fuel injection pump of FIG. 1 taken along a line II—II of FIG. 1.

A drive shaft 15 is held rotatably via a journal 16 by the housing 10. An oil seal 17 seals a clearance between the housing 10 and the drive shaft 15. As shown in FIG. 2, an eccentric cam 23, whose cross section is formed in circular shape and whose center axis is offset from a center axis of the drive shaft 15, is formed integrally with the drive shaft 15. In case of the fuel injection pump 1 having two cylinders according to the present embodiment, two of the plungers 21 and 22 are arranged on opposite sides of the drive shaft 15 at about 180° angular intervals. A center axis of the plunger 21 is parallel to that of the plunger 22.

An outer circumference of a cam ring 24 is formed in quadrangular shape. A bush 25 is interposed slidably between the cam ring 24 and the cam 23. The cam ring 25 is provided with a first sliding surface 24*a* on which an axial end 21*a* of the plunger 21 slides and a second sliding surface 24*b* on which an axial end 22*a* of the plunger 22 slides. The first and second sliding surfaces 24*a* and 24*b* are formed in non-parallel.

Each of springs 26 urges each of the plungers 21 and 22 toward the cam ring 24. The cam ring 24 slides via the bush 25 on the cam 23 and revolves about the cam 23 without self-rotating according to rotation of the drive shaft 15 together with the cam 23 so that each of the plungers 21 and 22 in slidable contact with the cam ring 24 moves relatively to the cam ring 24 reciprocatingly in right and left directions in FIG. 2, while moving axially and recirocatingly in upward and downward directions in FIG. 2. The plungers 21 and 22 are driven via the cam 23 and the cam ring 24 by the rotation of the drive shaft 15 with 180° angular phase difference. That is, when the plunger 21 moves axially in the cylindrical bore 12*a* toward the check valve 14 for pressuring fuel in the pressure chamber 31, the plunger 22 moves axially in the cylindrical bore 13*a* toward the drive shaft 15 for sucking fuel into the pressure chamber 32.

The plungers 21 and 22, the drive shaft 15, the cam 23 and the cam ring 24 are housed in an accommodation chamber 18 formed by the housing body 11 and the cylinder heads 12 and 13. The accommodation chamber 18 is filed with fuel that is light oil.

Each of the plungers 21 and 22, which is axially and reciprocatingly driven via the cam ring 24 by the cam 23 according to the rotation of the drive shaft 15, pressurizes fuel sucked via each of the check valves 14 from each of fuel flow in passages 33 into each of the pressure chambers 31 and 32. Each of the check valves 14 serves to prevent fuel reverse flow from each of the pressure chamber 31 and 32 to each of the fuel flow in passages 33.

Each of the cylinder heads 12 and 13 is provided with a fuel flow out passage 34 which extends in straight and communicates with each of the pressure chambers 31 and 32. The cylinder head 12 is provided on a downstream side of the fuel flow out passage 34 with an elongated hole-shaped fuel chamber 35 whose fuel flow area is larger than that of the fuel flow out passage 34. A check valve 36 is accommodated in the fuel chamber 35. An accommodation hole 37 whose fuel flow area is larger than that of the fuel chamber 35 is formed downstream the fuel chamber 35. The accommodation hole 37 is opened to an outer circumference of the cylinder head 12 for forming a fuel outlet. A fuel pipe joint 40 is screwed into the accommodation hole 37. The fuel pipe joint 40 is provided inside with a fuel passage 41 communicating with the fuel chamber 35. The fuel passage 41 is formed substantially on the same straight line as the fuel flow out passage 34.

The check valve 36 arranged in the cylinder head 12 downstream the fuel flow out passage 34 serves to prevent fuel reverse flow from the fuel chamber 35 positioned on a downstream side thereof via the fuel flow out passage 34 to the pressure chamber 31. The fuel pipe joint 40 is connected to a fuel pipe (not shown) that is connected to a common rail (not shown). The fuel pressurized in the fuel injection pump 1 is supplied via the fuel passage and the fuel pipe to the common rail. The fuel discharged from the fuel injection pump 1 is accumulated under high pressure in the common rail. High pressure fuel stored in the common rail is supplied to injectors (not shown) installed respectively in engine cylinders (not shown). Each of the injectors injects the fuel supplied from the common rail to each of the engine cylinders at a given timing and for a given time period.

The cylinder head 13 is positioned in the housing body 11 on a lower side thereof in FIG. 1. The cylinder head 13 is also provided with a fuel flow out passage 34, an accommodation hole 37 in which a check valve 36 and a fuel pipe joint 40 are housed and so on, similarly as the cylinder head 12.

A feed pump 50 for supplying fuel to the pressure chambers 31 and 32 is provided at an axial end of the drive shaft. The feed pump 50 supplies fuel from a fuel tank (not shown) to the pressure chambers 31 and 32 in such a manner that inner and outer rotors 51 and 52 of the feed pump 50 rotate relatively according to rotation of the drive shaft 15. A flow amount adjusting valve (not shown) is provided on a way of the fuel flow in passages 33 connecting the feed pump 50 and the pressure chambers 31 and 32. The flow amount adjusting valve serves to adjust an amount of fuel supplied from the feed pump 50 to the pressure chambers 31 and 32.

An operation of the fuel injection pump 1 is described below.

The cam 23 rotates according to rotation of the drive shaft 15 so that the cam ring 24 revolves about the cam 23 without self-rotating. The revolution of the cam ring 24 causes the plungers 21 and 22 to move axially and reciprocating, while the axial ends 21*a* and 22*a* of the plungers 21 and 22 slidably and reciprocatingly move relatively to the sliding surfaces 24*a* and 24*b* of the cam ring 24, respectively.

When the plunger 21 or 22 moves from an upper dead point downward toward the drive shaft 15 according to the revolution of the cam ring 24, the fuel whose amount is adjusted by the flow amount adjusting valve after being discharged from the feed pump 50 is flowed in the pressure chamber 31 or 32 via the check valve 14 from the fuel flow in passage 33.

When the plunger 21 or 22 further moves from a lower dead point upward toward the upper dead point, the check valve 14 is closed so that pressure of the fuel in the pressure chamber 31 or 32 increases. When the pressure of the fuel in the pressure chamber 31 or 32 exceeds pressure of fuel of the fuel passage 41, the check valve 36 is opened so that the fuel pressurized in the pressure chamber 31 or 32 is discharged to the fuel passage 41.

The fuel discharged from the pressure chamber 31 or 32 is delivered via the fuel flow out passage 34, the check valve 36 and the fuel chamber 35 to the fuel passage 41 and, then, to the common rail where pressure of fuel is kept constant by accumulating the fuel delivered from the fuel injection pump with pressure fluctuation. Since the plungers 21 and 22 are driven with 180° angular phase difference, the fuel is discharged alternately from the pressure chambers 31 and 32.

When the plunger 21 or 22 moves downward toward the drive shaft 15 and fuel is sucked into the pressure chamber 31 or 32, the plunger 21 or 22 is in the intake stroke. When the plunger 21 or 22 moves upward toward the check valve 14 and the fuel sucked into the pressure chamber 31 or 32 is pressurized, the plunger 21 or 22 is in the compression stroke. Since the plungers 21 and 22 are arranged on opposite sides of the cam ring 24, the plungers 21 and 22 are driven with a phase difference. That is, when the plunger 21 is in the compression stroke, the plunger 22 is in the intake stroke.

Figure 3:
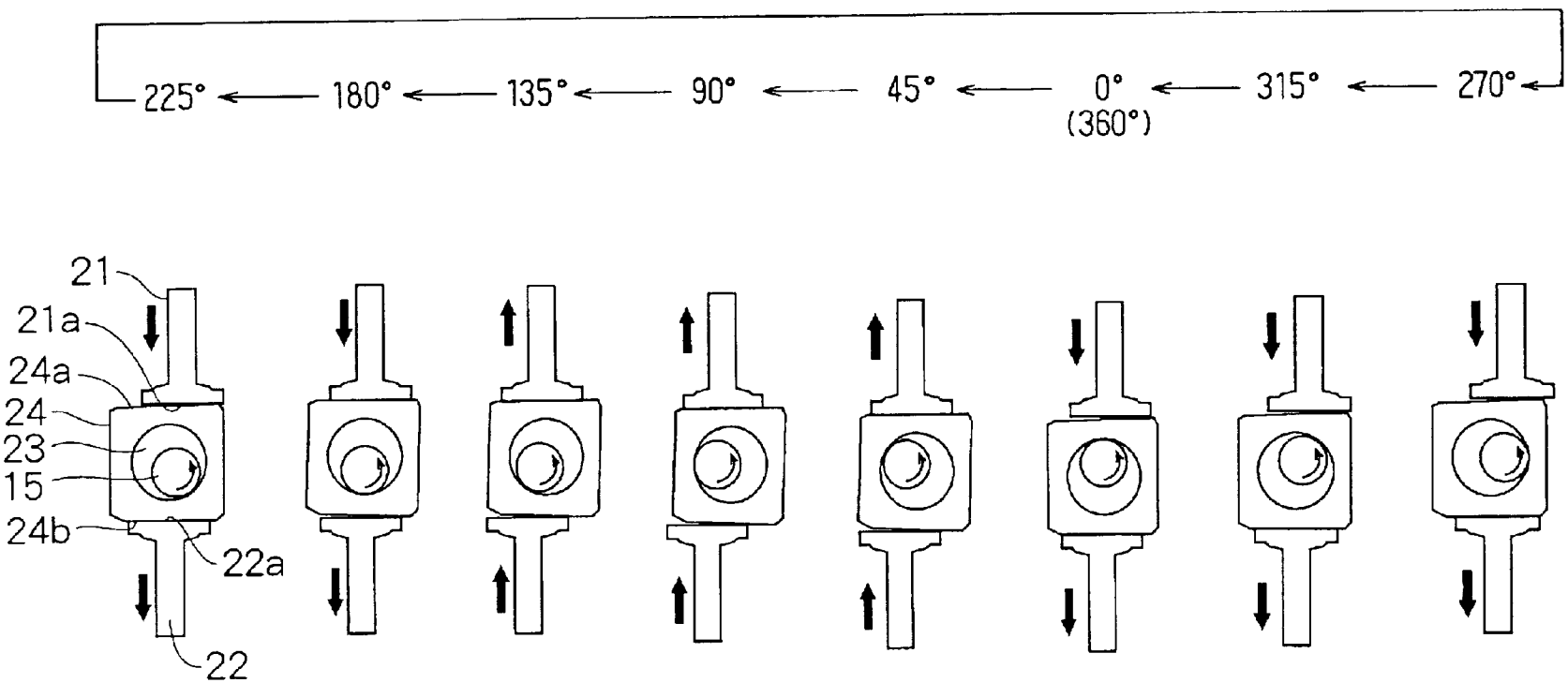
FIG. 3 is a chart showing a movement of the plunger relative to the cam ring according to rotation of a drive shaft according to the first embodiment.

As shown in FIG. 3, when the plunger 21 is positioned at the lower dead point, the plunger 22 is positioned at the upper dead point. Assuming that rotation angle θ of the drive shaft 15 is 0° at this position, the plunger 21 moves from the lower dead point to the upper dead point in the cylinder bore 12*a* when the rotation angle θ of the drive shaft 15 is changed in a range of $0° < \theta < 180°$, which means that the plunger 21 is in the compression stroke. At the same time, the plunger 22 is in the intake stroke where the plunger 22 moves from the upper dead point to the lower dead point in the cylinder bore 13*a*, when the rotation angle θ of the drive shaft 15 is changed in a range of $0° < \theta < 180°$.

When the plunger 21 is in the compression stroke, the plunger 21 receives large reaction force acting toward the cam ring 24 from high pressure fuel in the pressure chamber 31. On the other hand, the plunger 21 receives biasing force of the spring 26 that acts toward the cam ring 24. The reaction force of fuel pressure applied to the plunger 21 is larger than the biasing force of the spring 26 applied to the plunger 22. Therefore, an entire part of the axial end 21*a* of the plunger 21 comes in contact with the first sliding surface 24*a*.

As shown in FIG. 2, since first and second sliding surfaces 24*a* and 24*b* of the cam ring 24 are formed in non-parallel and the center axis of the plunger 21 is parallel to that of the plunger 22, when the entire part of the axial end 21*a* of the plunger 21 comes in sliding contact with the first sliding surface 24*a* on both sides (right and left sides in FIG. 2) of an axis of the drive shaft 15, only a part of the axial end 22*a* of the plunger 22 comes in contact with the second sliding surface 24*b* on one side (left side in FIG. 2) of the axis of the drive shaft 15 so that a gap is formed between the axial end 22*a* of the plunger 22 and the second sliding surface 24*b* on the other side (right side in FIG. 2) of the axis of the drive shaft 15. The cross section of the gap perpendicular to the axis of the drive shaft 15 is formed in shape of a wedge whose angle is α. The fuel filled in the accommodation chamber 18 can easily enter the gap. It is preferable that height of the gap is relatively low but higher than that of each surface roughness of the axial end 22*a* of the plunger 22 and the second sliding surface 24*b* to an extent that an oil film by fuel is sufficiently formed between the axial end 22*a* of the plunger 22 and the second sliding surface 24*b* for preventing frictional seizure of mutual sliding contact portions of the plunger 22 and the cam ring 24 in the compression stroke.

As shown in FIG. 3, when the rotation angle θ of the drive shaft 15 is 180° (θ=180°), the plunger 21 is at the upper dead point where the compression stroke has just finished and the plunger 22 is at the lower dead point where the intake stroke has just finished.

When the rotation angle θ of the drive shaft 15 is changed in a range of $180° < \theta < 360°$, the plunger 21 moves from the upper dead point to the lower dead point in the cylinder bore 12*a*, which means that the plunger 21 is in the intake stroke and the plunger 22 is in the compression stroke. The entire part of the axial end 22*a* of the plunger 22 comes in contact with the second sliding surface 24*b* on both sides (right and left sides in FIG. 2) of an axis of the drive shaft 15 and, therefore, only a part of the axial end 21*a* of the plunger 21 comes in contact with the first sliding surface 24*b* on one side (right side in FIG. 2) of the axis of the drive shaft 15 so that a gap is formed between the axial end 21*a* of the plunger 21 and the first sliding surface 24*b* on the other side (left side in FIG. 2) of the axis of the drive shaft 15, since the first and second sliding surfaces 24*a* and 24*b* are non-parallel. Accordingly, a gap is formed between the axial end 21*a* of the plunger 21 and the first sliding surface 24*a* on the other side (left side in FIG. 2) of the axis of the drive shaft 15. The cross section of the gap perpendicular to the axis of the drive shaft 15 is formed in shape of a wedge whose angle is α, which is substantially same as that of the gap formed between the axial end 22*b* of the plunger 22 and the second sliding surface 24*b* of the cam ring 24. The fuel filled in the accommodation chamber 18 can easily enter the gap.

When the rotation angle θ of the drive shaft 15 becomes 360° (θ=360°), the drive shaft 15 finishes one cycle rotation and returns to an initial position (θ=0°). Then, the operation mentioned above is repeated.

As mentioned above, in the fuel injection pump 1 according to the first embodiment, the gap is formed between the plunger 21 or 22 and the cam ring 24 in the intake stroke. Accordingly, the fuel filled in the accommodation chamber 18 can easily enter the gap when the plunger 21 or 22 is in the intake stroke. The fuel entered the gap serves to promote formation of the oil film between the axial end 21*a* or 22*a* of the plunger 21 or 22 and the first or second sliding surface 24*a* or 24*b* when the plunger 21 or 22 is in the compression stroke in which the plunger 21 or 22 receives the large reaction force acting toward the cam ring 24. The formation of the oil film by the fuel prevents frictional seizure of mutual sliding contact portions of the plunger 21 or 22 and the cam ring 24.

The above advantage can be achieved by making the first and second sliding surfaces 24*a* and 24*b* of the cam ring 24 non-parallel so that the construction of the cam ring 24 is simpler and the manufacturing thereof is easier.

(Second Embodiment)

Figure 4:
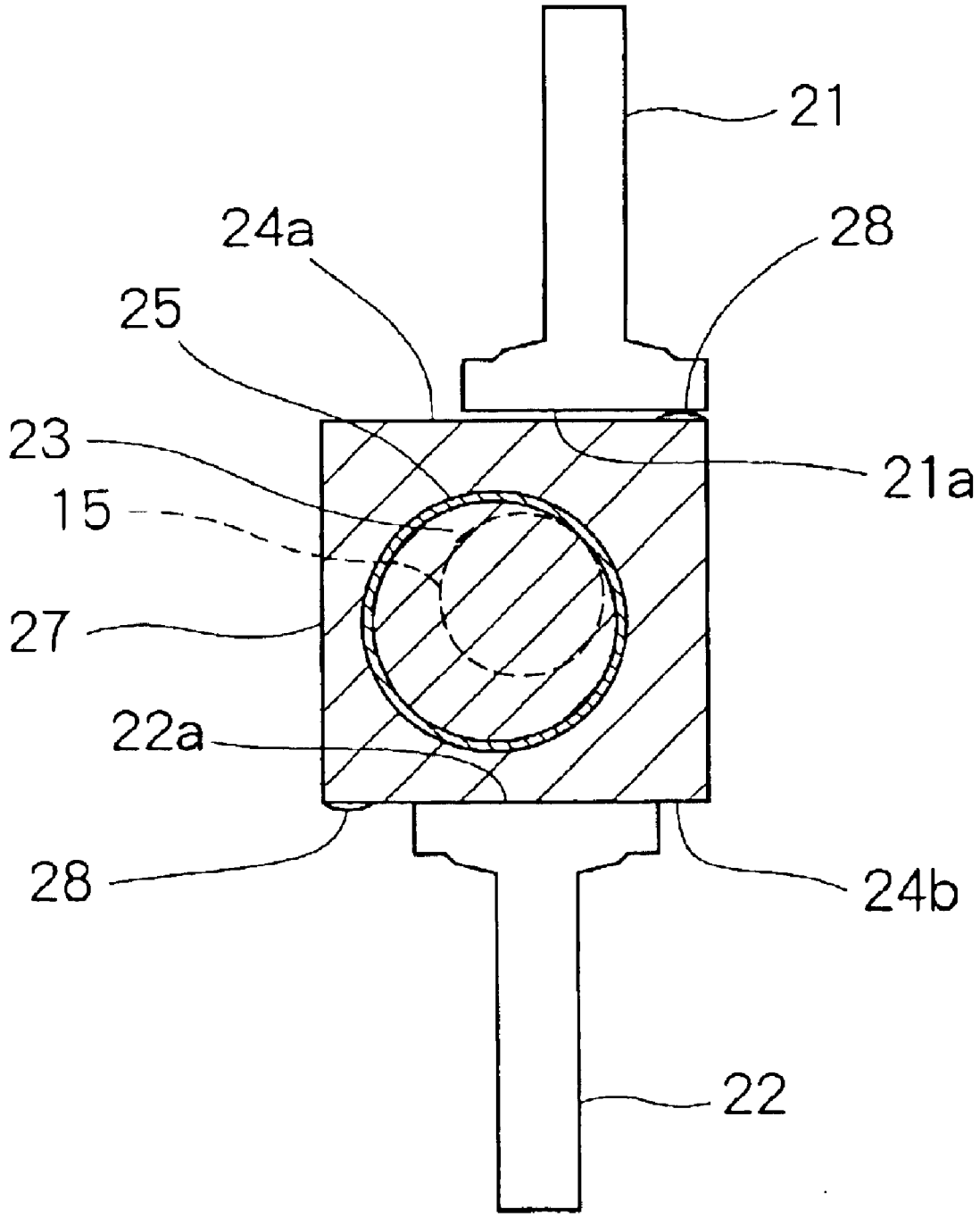
FIG. 4 is a cross sectional view showing a plunger and a cam ring of a fuel injection pump according to a second embodiment.

As shown in FIG. 4, a cam ring 27 of a fuel injection pump according to a second embodiment has projections 28. The projections 28 are formed on first and second sliding surfaces 27*a* and 27*b* of the cam ring 27, respectively. According to the second embodiment, the first and second sliding surfaces 27*a* and 27*b* are formed substantially in parallel.

Each of the projections 28 protrudes from the first or second sliding surface 27*a* or 27*b* of the cam ring 27 toward the plunger 21 or 22. Height of the projection 28 is relatively low but higher than that of each surface roughness of the axial end 21*a* or 22*a* of the plunger 21 or 22 and the first or second sliding surface 27*a* or 27*b* of the cam ring 27. The respective projections 28 are positioned at the first sliding surface 27*a* on one side (right side in FIG. 4) of an axis of the drive shaft 15 ant at the second sliding surface 27*b* on the other side (left side in FIG. 4) of an axis of the drive shaft 15. It is preferable that positions of the projections 28 are substantially symmetric with respect to the axis of the drive shaft 15. When the plunger 21 or 22 is in the intake stroke, a part of the axial end 21*a* or 22*a* of the plunger 21 or 22 runs onto the projection 28 formed on the first or second sliding surface 27*a* or 27*b* so that a gap, whose height is substantially same as that of the projection 28, is formed between the other part of the axial end 21*a* or 22*a* of the plunger 21 or 22 and the first or second sliding surface 27*a* or 27*b* of the cam ring 27, since, in the intake stroke, the cam ring 27 slidably moves relatively to the plunger 21 reciprocatingly (first in right direction and, then, in left direction perpendicularly to an axis of the plunger 21), while causing the plunger 21 to axially move toward the drive shaft 15, and slidably moves relatively to the plunger 22 reciprocatingly (at first, in left direction and, then, in right direction perpendicularly to an axis of the plunger 22), while causing the plunger 22 to axially move toward the drive shaft 15.

Figure 5:
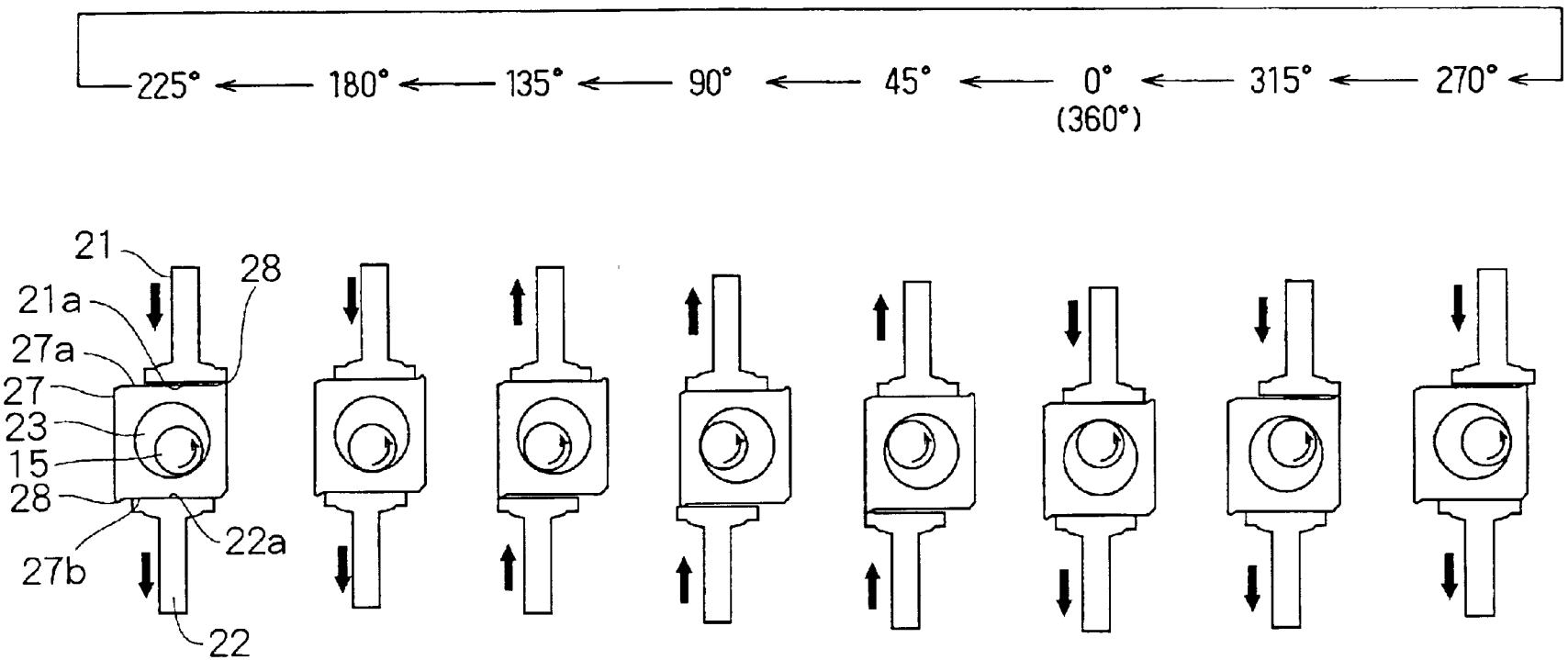
FIG. 5 is a chart showing a movement of the plunger relative to the cam ring according to rotation of a drive shaft according to the second embodiment.

As shown in FIG. 5, when the plunger 21 is positioned at the lower dead point, the plunger 22 is positioned at the upper dead point. When the rotation angle θ of the drive shaft 15 is changed in a range of 0°<θ<180°, the plunger 21 is in the compression stroke and the plunger 22 is in the intake stroke. The cam ring 27 causes the plunger 21 to axially move in a direction opposite to the drive shaft 15 and the plunger 22 to axially move toward the drive shaft 15. At this time, at first, the cam ring 27 slidably moves relatively to the plungers 21 and 22 in right direction. Therefore, the axial end 22*a* of the plunger 22 runs onto the projection 28 on the second sliding surface 27*b* of the cam ring 27, though an entire part of the axial end 21*a* of the plunger 21 keeps in contact with the first sliding surface 27*a*. Since the reaction force by fuel applied to the plunger 21 is larger than the biasing force of the spring 26 applied to the plunger 22, only a part (periphery) of the axial end 22*a* of the plunger 22 comes in contact with the projection 28 of the second sliding surface 27*b* so that the gap, whose height is substantially equal to that of the projection 28, is formed between the other part of the axial end 22*a* of the plunger 22 and the second sliding surface 27*b*. Then, when the cam ring 27 slidably moves relatively to the plungers 21 and 22 in left direction, the axial end 22*a* of the plunger 22 leaves the projection 28 of the second sliding surface 27*b* so that an entire part of the axial end 22*a* of the plunger 22 comes in contact with the projection 28 of the second sliding surface 27*b*, while the entire part of the axial end 21*a* of the plunger 21 still keeps in contact with the first sliding surface 27*a*.

When the rotation angle θ of the drive shaft 15 is changed in a range of 180°<θ<360°, the plunger 21 is in the intake stroke and the plunger 22 is in the compression stroke. The cam ring 27 causes the plunger 21 to axially move toward the drive shaft 15 and the plunger 22 to axially move in a direction opposite to the drive shaft 15. At this time, when the cam ring 27 slidably moves relatively to the plungers 21 and 22 further in left direction, the axial end 21*a* of the plunger 21 runs onto the projection 28 on the first sliding surface 27*a* of the cam ring 27, though an entire part of the axial end 22*a* of the plunger 22 keeps in contact with the second sliding surface 27*b*. Accordingly, only a part (periphery) of the axial end 21*a* of the plunger 21 comes in contact with the projection 28 of the first sliding surface 27*a* so that a gap is formed between the other part of the axial end 21*a* of the plunger 21 and the first sliding surface 27*a*. Then, when the cam ring 27 slidably moves relatively to the plungers 21 and 22 in right direction, the axial end 21*a* of the plunger 21 leaves the projection 28 of the first sliding surface 27*a* so that an entire part of the axial end 21*a* of the plunger 21 comes in contact with the projection 28 of the first sliding surface 27*a*, while the entire part of the axial end 22*a* of the plunger 22 still keeps in contact with the second sliding surface 27*b*.

As mentioned above, according to the second embodiment, when the plunger 21 or 22 is in the intake stroke, the gap is formed between the axial end 21*a* or 22*a* of the plunger 21 or 22 and the first or second sliding surface 27*a* or 27*b* of the cam ring 27 so that fuel easily enters the gap from the accommodation chamber 18 and the oil film for lubrication is formed, similarly as the first embodiment, resulting in preventing the frictional seizure of the sliding contact portions of the plunger 21 or 22 and the cam ring 27.

What is claimed is:

1. A fuel injection pump comprising:

a pump housing having a pair of cylindrical bores axially opposing each other;

a drive shaft rotatably supported by the housing;

an eccentric cam integrally formed with the drive shaft;

a cam ring having a quadrangular shape and arranged around an outer circumference of the eccentric cam, the cam ring having a pair of flat sliding surfaces at opposite sides thereof with respect to the drive shaft;

a pair of plungers movably accommodated in the cylindrical bore, respectively, each of the plungers being urged toward the cam ring so that a respective first axial end of each of said plungers comes in contact with the respective sliding surfaces of the cam ring;

a pair of pressure chambers formed by the cylindrical bores and respective second axial ends of the plungers;

a pair of check valves formed in the housing and respectively connected to the pressure chambers, so that when the plunger moves in its axial direction toward the cam ring, fuel is sucked into the pressure chamber and when the plunge moves in the opposite direction, the fuel in the pressure chamber will be pressurized;

wherein the sliding surfaces are formed in non-parallel planes, so that a substantially entire part of the first axial end of one said plunger comes in contact with the sliding surface when the fuel in the one respective pressure chamber is pressurized, while a wedge shape gap is formed between the first axial end of the other said plunger and the other sliding surface when fuel is sucked into the respective other pressure chamber.

2. A fuel injection pump comprising:

a pump housing having a pair of cylindrical borer axially opposing each other;

a drive shaft rotatably supported by the housing an eccentric cam integrally formed with the drive shaft;

a cam ring having a quadrangular shape and arranged around a outer circumference of the eccentric cam, the cam ring having a pair of flat sliding surfaces at opposite sides thereof with respect to the drive shaft;

a pair of plungers movably accommodated in the cylindrical bores, respectively, each of the plungers being urged toward the cam ring so that a respective first axial end of each of said plungers comes in contact with the respective sliding surfaces of the cam ring;

a pair of pressure chambers formed by the cylindrical bores and respective second axial ends of the plungers;

a pair of check valves formed in the housing and respectively connected to the pressure chambers, so that when the plunger moves in its axial direction toward the cam ring, fuel is sucked into the pressure chamber and when the plunger moves in the opposite direction, the fuel in the pressure chamber will be pressurized;

wherein the sliding surfaces are formed in parallel and a pair of projections are formed on the sliding surfaces, so that a substantially entire part of the first axial end of one said plunger comes in contact with the sliding surface when the fuel in the respective one pressure chamber is being pressurized, while a gap is formed between the first axial end of the other said plunger and the other sliding surface when the axial end of the other plunger comes in contact with the projection formed on the other sliding surface when the fuel is sucked into the respective other pressure chamber.

* * * * *